US007540688B1

(12) United States Patent
Suckow et al.

(10) Patent No.: US 7,540,688 B1
(45) Date of Patent: Jun. 2, 2009

(54) BREAKDOWN SCREED PLATE

(76) Inventors: Robert E. Suckow, 515 First St. North, Maynard, IA (US) 50655; Richard A. Suckow, 1214 Third St. NE., Oelwein, IA (US) 50662

( * ) Notice: Subject to any disclaimer, the term of this patent is extended or adjusted under 35 U.S.C. 154(b) by 0 days.

(21) Appl. No.: 11/764,298

(22) Filed: Jun. 18, 2007

Related U.S. Application Data

(62) Division of application No. 11/172,294, filed on Jun. 30, 2005, now Pat. No. 7,293,938.

(51) Int. Cl.
*E01C 19/22* (2006.01)

(52) U.S. Cl. ..... 404/114; 404/118

(58) Field of Classification Search ..... 404/114, 404/118

See application file for complete search history.

(56) References Cited

U.S. PATENT DOCUMENTS 4,359,296 A * 11/1982 Cronkhite ..... 404/114
4,573,717 A * 3/1986 Peacock ..... 285/365
4,798,494 A 1/1989 Allen
4,838,730 A 6/1989 Owens
5,324,085 A * 6/1994 Hintz, Jr. ..... 294/16
5,468,095 A * 11/1995 Dawson ..... 404/118
5,980,154 A * 11/1999 Record ..... 404/97
6,089,787 A 7/2000 Allen et al.
6,293,780 B1 9/2001 Rijkers
6,374,569 B1 4/2002 Suckow
6,728,994 B1 * 5/2004 Rushin et al. ..... 16/426
6,758,631 B2 7/2004 Frankeny, II
6,981,819 B1 1/2006 Suckow et al.
7,097,384 B2 * 8/2006 Lindley ..... 404/118
7,293,938 B1 * 11/2007 Suckow et al. ..... 404/114

* cited by examiner

*Primary Examiner*—Gary S Hartmann
(74) *Attorney, Agent, or Firm*—McKee, Voorhees & Sease, P.L.C.

(57) ABSTRACT

A screed assembly includes a screed plate, a console assembly, and a first and second handles. The various components of the screed assembly are attached to one another with quick connect mechanisms so that they can be disassembled for cleaning and transport and reassembled at a new site. A tilt mechanism operated by a horizontal beam of light can also be utilized and is also attached by a quick connect mechanism.

8 Claims, 5 Drawing Sheets

BREAKDOWN SCREED PLATE

CROSS-REFERENCE TO RELATED APPLICATIONS

This application is a Divisional application of U.S. application Ser. No. 11/172,294 filed Jun. 30, 2005, which application is hereby incorporated by reference in its entirety.

BACKGROUND OF THE INVENTION

This patent application relates to a breakdown screed plate.

Screeding devices have been used for leveling and consolidating curing concrete. These screeds usually include a horizontal plate which is moved across the surface of the concrete to level the concrete and prepare it for finishing. Vibrators are sometimes used to cause the screed plate to vibrate against the surface of the concrete in order to consolidate it.

Some prior art screeds utilize an internal combustion engine mounted on the screed plate for causing the vibration of the screed plate. These internal combustion engines are heavy and add substantially to the weight of the screed.

Other screed devices utilize an electric motor requiring a cord to extend from the screed to an electrical outlet. These cords often drag on the concrete and deform the surface of the concrete. There is also a safety hazard with electrical cords because the concrete is wet.

Many prior art screed devices have one or more handles for moving the screed plate across the surface of the concrete. Also, it is desirable to adjust the angle of the screed plate relative to the concrete surface. At times it is desirable to lift the leading edge of the screed plate to allow more concrete under the plate for filling low areas. Other times it is desirable to lift the trailing edge of the concrete so that the leading edge cuts into the concrete and removes it from a high spot. A screed plate is normally pulled by the handles toward the operator, and therefore the leading edge is the edge of the screed plate presented toward the operator.

It is often desirable to disassemble the screed plate at the site for cleaning and for transporting. Therefore, an easy way for assembling and disassembling the screeding device is important.

Therefore a primary object of the present invention is the provision of an improved vibrating screed.

A further object of the present invention is the provision of a vibrating screed which is easy to handle in transporting and which may be easily assembled and disassembled with no tools needed.

A further object of the present invention is the provision of an improved screed plate which can be adjusted to any operator's height.

A further object of the present invention is the provision of a vibrating screed which can switch and interchange the handles from right to left or from left to right.

A further object of the present invention is the provision of a vibrating screed which has instant response to a variable speed control switch which utilizes a rechargeable battery pack rather than an internal combustion engine or an electric cord.

A further object of the present invention is the provision of a screed plate which can be angled and tilted easily to accommodate raised portions or lowered portions of the surface of the concrete.

A further object of the present invention is the provision of a screed plate which can sense the height of a beam of light relative to the concrete surface and by so doing determine whether the concrete surface is level, includes rises, or includes lowered portions.

A further object of the present invention is the provision of a vibrating screed plate which can be operated in enclosed areas without causing harmful emission or fumes.

A further object of the present invention is the provision of a vibrating screed plate that will adapt for manual use of a laser for leveling.

A further object of the present invention is a screed plate that has a unique pointed leading edge and an upwardly curved surface above the leading edge for engaging excess concrete.

A further object of the present invention is the provision of an improved screed plate which is economical to manufacture, durable in use, and efficient in operation.

BRIEF SUMMARY OF THE INVENTION

The foregoing objects may be achieved by a screed plate which permits the operator to finish a quantity of uncured cement. The screed plate comprises a substantially horizontal surface adapted to engage the quantity of uncured cement and having a leading edge, a trailing edge, a first end, a second end, an upper surface, and a lower surface. A console assembly contains at least a vibrator capable of actuation to vibrate, the console assembly being either directly or indirectly in contact with the screed plate so that the vibrator when activated imparts vibrations to the screed plate. A console quick connect mechanism detachably connects the console assembly to the screed plate for quick removal of the console assembly from the screed plate. A first handle and a second handle each have a lower end adjacent the console assembly and an upper end for grasping by the operator. First and second handle quick connect mechanisms detachably connect the lower ends of the first and second handles respectively to the console assembly for quick removal of the first and second handles from the console assembly.

According to another feature of the present invention the console quick connect mechanism is comprised of a first latch that is manually moveable between an attached position connecting the console assembly to the screed plate and a removable position permitting removal of the console assembly from the screed plate.

According to a further feature of the present invention the console quick connect mechanism is comprised of a second latch that is manually moveable between an attached position connecting the console assembly to the screed plate and a removable position permitting removal of the console assembly from the screed plate.

According to another feature of the present invention the console quick connect mechanism is comprised of a third latch that is manually moveable between an attached position connecting the console assembly to the screed plate and a removable position permitting removal of the console assembly from the screed plate.

According to another feature of the present invention the screed plate includes an upstanding plate having a forward surface and a rear surface. The first and second latches engage the console assembly and press the console assembly against one of the forward and rearward facing surfaces of the upstanding plate when the first and second latches are in the attached position. The third latch engages the other of the forward and rear facing surfaces of the upstanding plate when the third latch is in the attached position.

According to another feature of the present invention the console assembly has a first retention member and a screed plate. The screed plate includes a second retention member. The first and second retention members detachably retentively engage one another when the console quick connect assembly connects the console assembly to the screed plate. The first retention member is a retention plate having a retention edge and the second retention member is a retention slot detachably retentively embracing the retention edge. According to another feature of the present invention the handles are quickly and easily removable from the screed plate.

According to another feature of the present invention the console, the handles, and the screed plate can be easily and quickly disassembled for cleaning and transporting.

According to another feature of the present invention the leading edge of the screed plate has in cross section a pointed edge with a curved upper surface extending upwardly and in a rearward direction from the pointed edge. This feature permits the screed plate to dig into the uncured concrete and causes the uncured concrete to curl up and fall downwardly in front of the leading edge of the screed plate.

DETAILED DESCRIPTION OF THE PREFERRED EMBODIMENT

Figure 3:
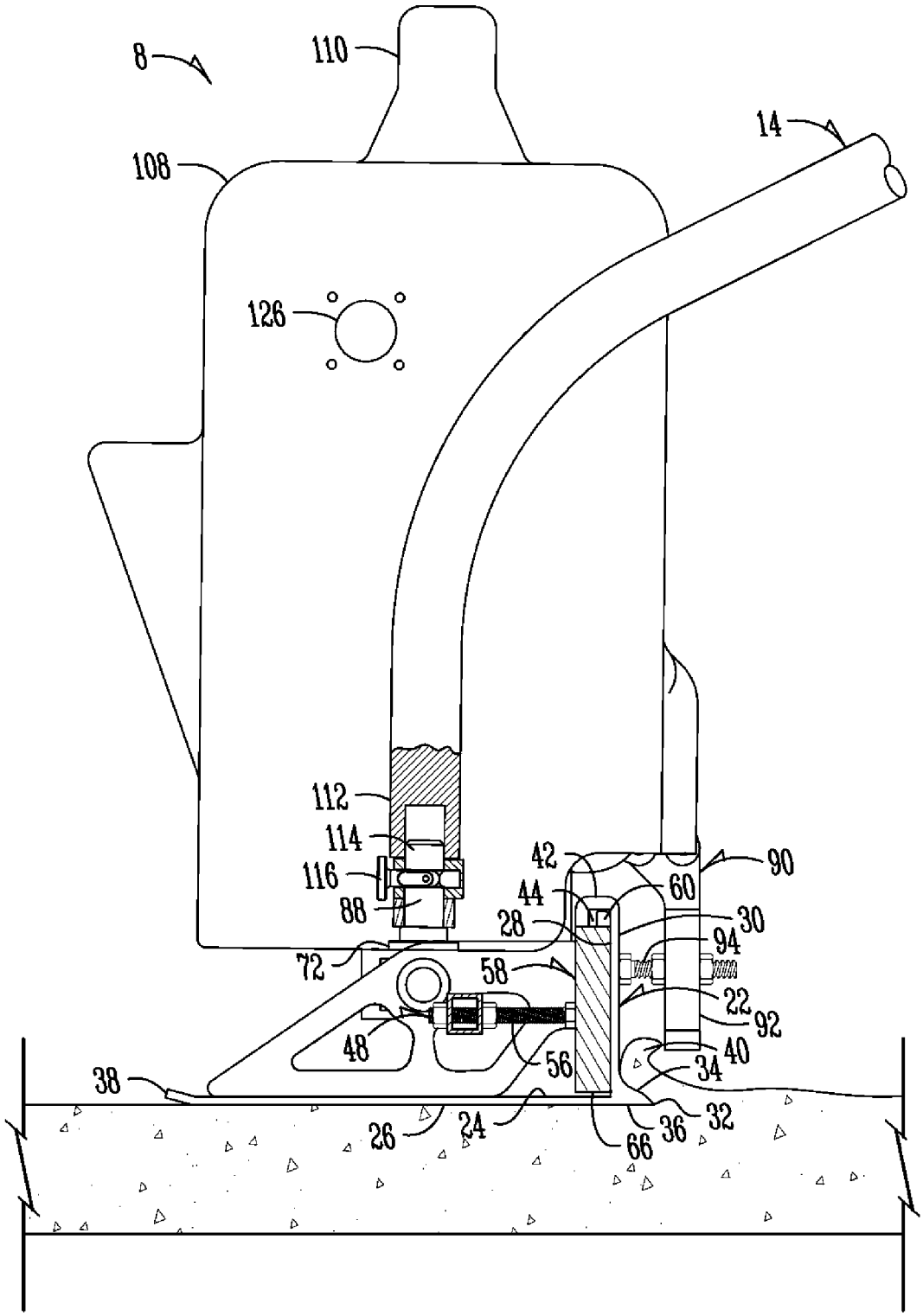
FIG. 3 is a sectional view taken along line 3-3 of FIG. 1.

Referring to the drawings, a screed assembly 8 includes a screed plate 10, a console assembly 12, a first handle 14, a second handle 16, and a leveling assembly 18. Screed plate 10 includes a horizontal plate 20 and a vertical plate 22. The horizontal plate 20 includes an upper surface 24 and a lower surface 26. The lower surface is adapted to engage the uncured concrete as shown in FIG. 3. The vertical plate 22 includes a rear surface 28 and a front surface 30. The horizontal plate 20 includes a leading pointed edge 32 (FIG. 3) which has extending upwardly there from a curved upper surface 34, and which includes a flat lower surface 36 presented downwardly. The lower surface 36 is a continuation of the lower surface 26. The leading pointed edge 32 and the curved upper surface 34 permit the screed plate 10 to dig into the uncured concrete so as to create a concrete roll 40 (FIG. 3) which rolls and falls in front of the leading pointed edge 32. The screed plate 10 includes an angled rear edge 38.

Figure 1:
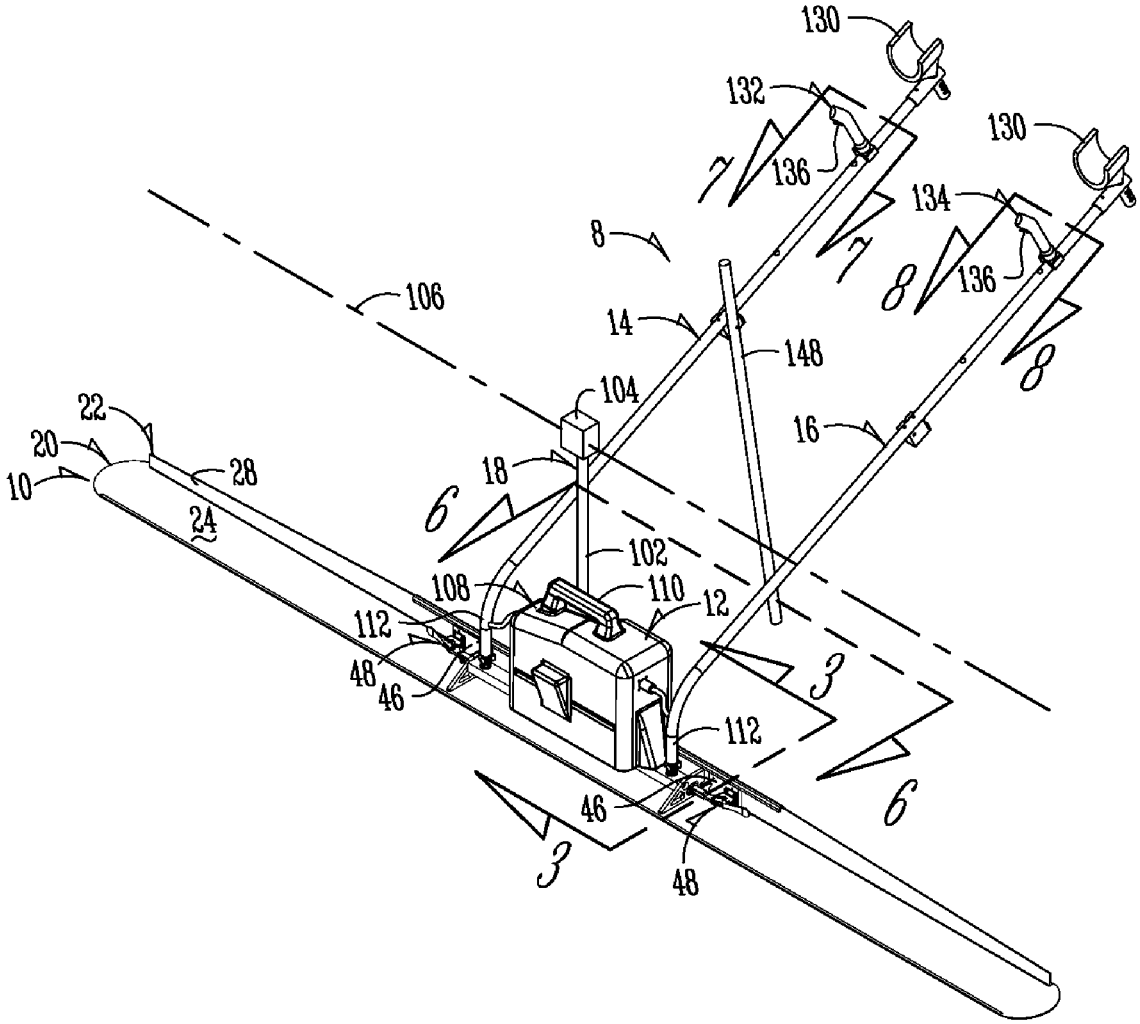
FIG. 1 is a perspective view of the assembled screed plate assembly of the present invention.
Figure 4:
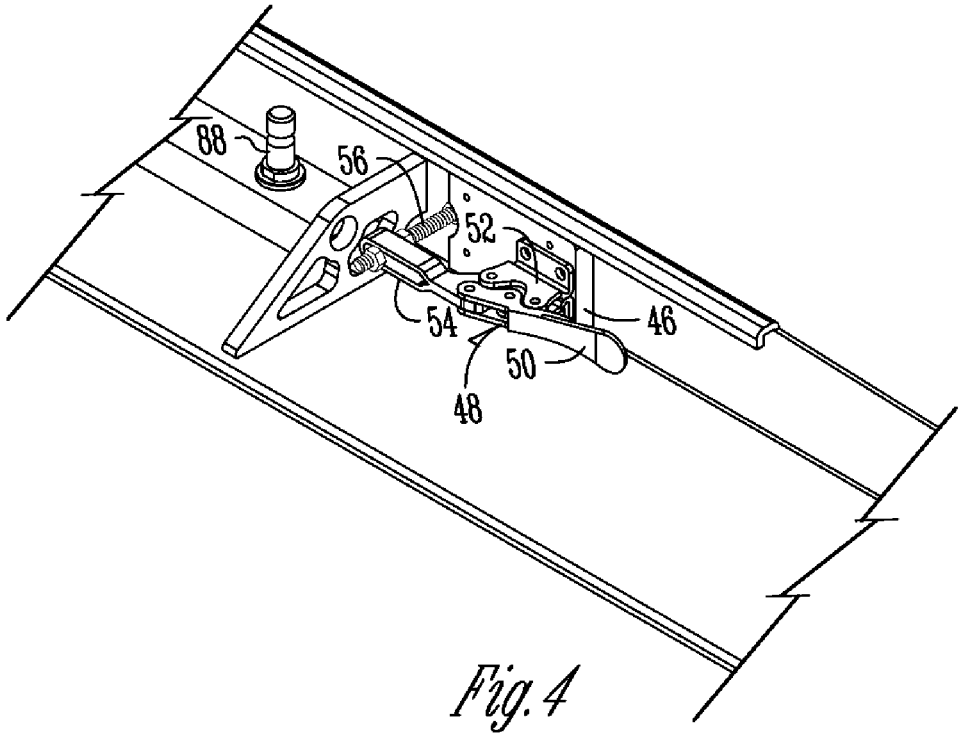
FIG. 4 is a perspective view of the latch mechanism of the present invention shown in its closed or locked position.
Figure 5:
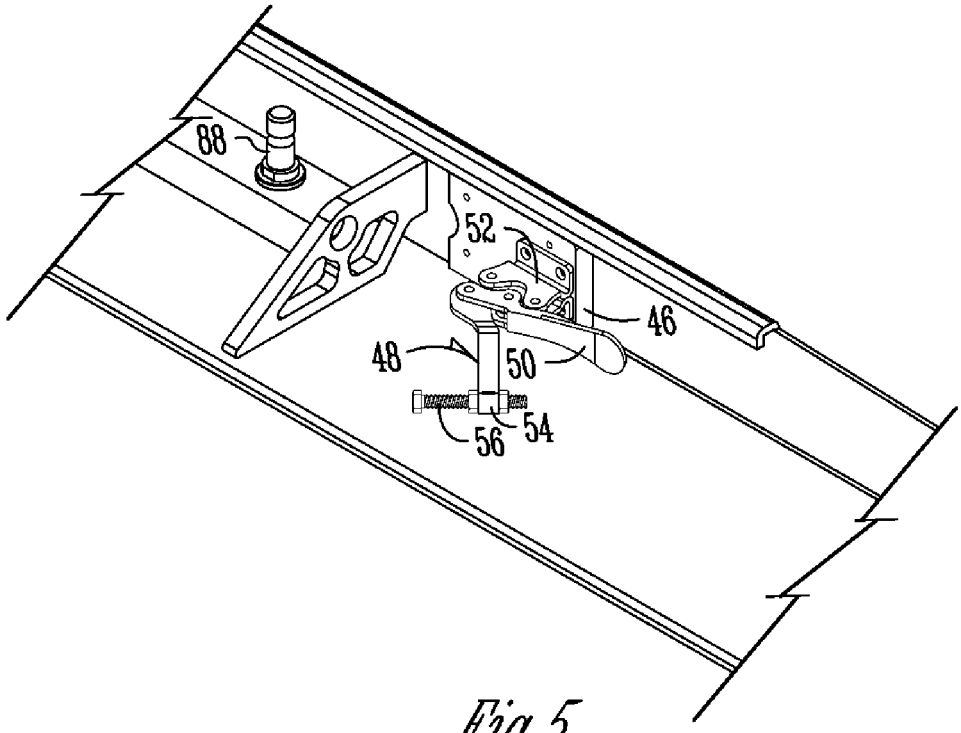
FIG. 5 is a view similar to FIG. 4, but showing the latch mechanism in its open position.

The vertical plate 22 includes a curled upper edge 42 (FIG. 3) which provides a slot 44. As can be seen in FIGS. 3-5, the slot 44 houses spaced apart rear clamp blocks 46 (see also FIGS. 1 and 2) which are spaced apart a pre-determined distance to be described in more detail hereafter.

The rear clamp blocks 46 are rigidly mounted to the vertical plate 22 by bolts or other securing members. Attached to the rear clamp blocks 46 are rear clamps 48 each of which comprises a rear clamp handle 50, a rear clamp hinge 52, a rear clamp bolt holder 54, and a rear clamp bolt 56. As can be seen in FIGS. 4 and 5, the rear clamps 48 are pivotally mounted so that handle 50, bolt holder 54, and bolt 56 will move in a toggle fashion from their open position shown in FIG. 5 to their closed position shown in FIG. 4. The purpose for this movement will be shown hereafter.

Console assembly 12 is comprised of a console plate 58 having a reduced cross section upper edge 60 (FIG. 3), an end edge 62 (FIG. 2) and an end edge 64. The distance between edges 62, 64 is slightly less than the distance between clamp blocks 46 so that the console plate 58 can fit between the clamp blocks 46. FIG. 3 shows the console plate 58 with the reduced cross section upper edge 60 fitted within slot 44 of the curled upper edge 42 of vertical plate 22. The console plate 58 includes a lower edge 66 which fits against the upper surface 24 of horizontal plate 20.

Figure 2:
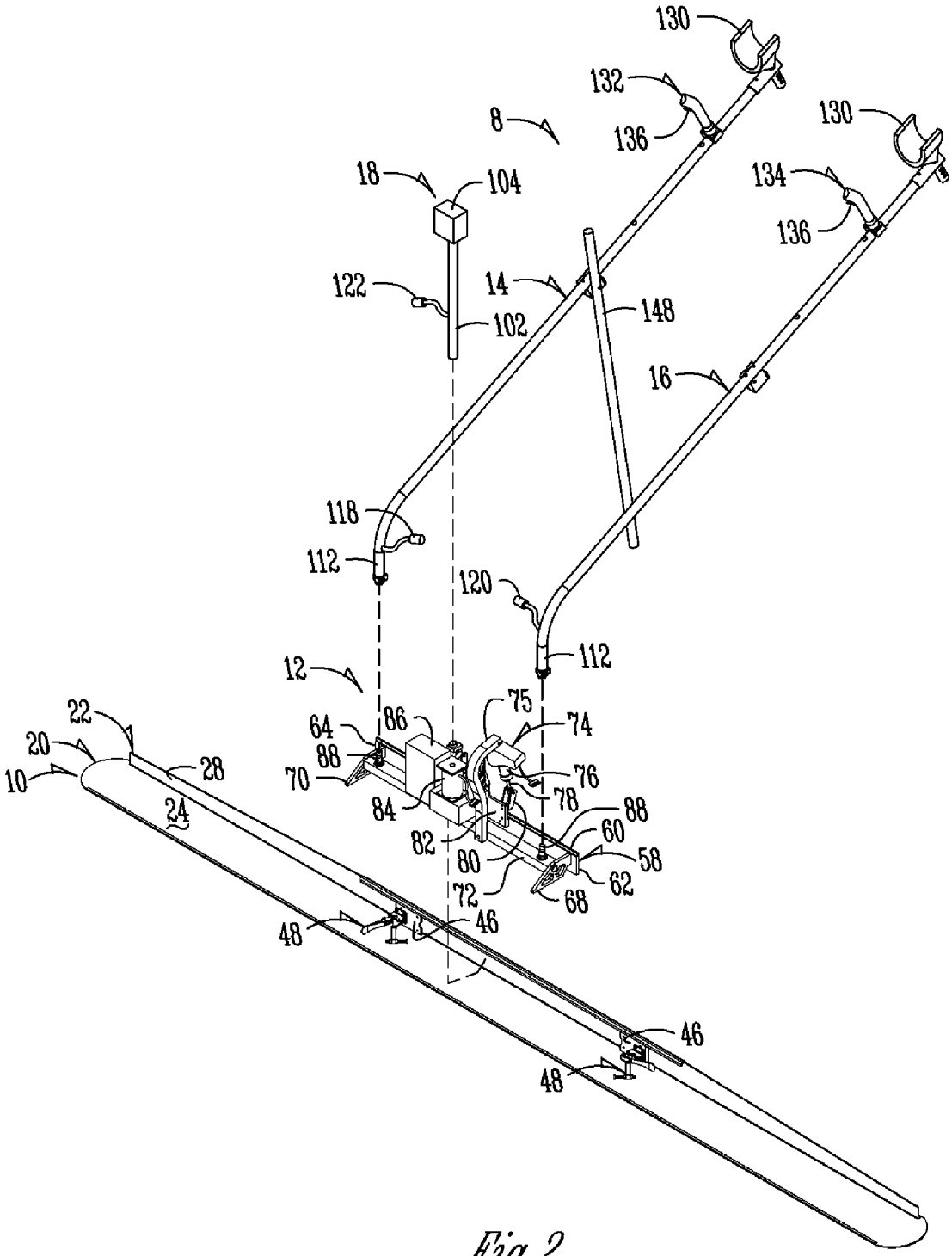
FIG. 2 is an exploded view similar to FIG. 1, but showing the console cover removed.

Referring to FIG. 2 which shows the cover of the console removed, the console assembly includes a rearwardly extending pair of spaced apart mounting plates 68, 70. These mounting plates are attached to the console plate 58 by welding or the like and extend rearwardly there from. Vertically mounted between the mounting plates 68, 70 is a pivot bar 72 which is adapted to pivot along its longitudinal axis. A tilt actuator 74 includes a question mark-shaped bar 75 which is attached at its lower end to the pivot bar 72 and which is attached at its upper end to a solenoid cylinder 76. Extending from the solenoid cylinder 76 is a solenoid rod 78 which is pivotally attached to a link 80. Link 80 is pivotally connected to a support plate 82 which is welded or otherwise attached to the console plate 58. Extension and retraction of the solenoid cylinder 76, 78 causes the tilt bar 50 to pivot about its horizontal pivot axis. Because the other end of the tilt actuator 74 is connected to the console plate 58, and because the console plate 58 is attached to the vertical plate 22 of screed plate 10, the extension and retraction of the solenoid cylinder 76 and solenoid rod 78 causes the screed plate 10 to tilt about its horizontal longitudinal axis.

Also included on the console assembly 12 are a vibrator motor 84 and a circuitry box 86. The pivot bar 72 is provided with two spaced apart stub shafts 88 for mounting the handles 14.

Figure 6:
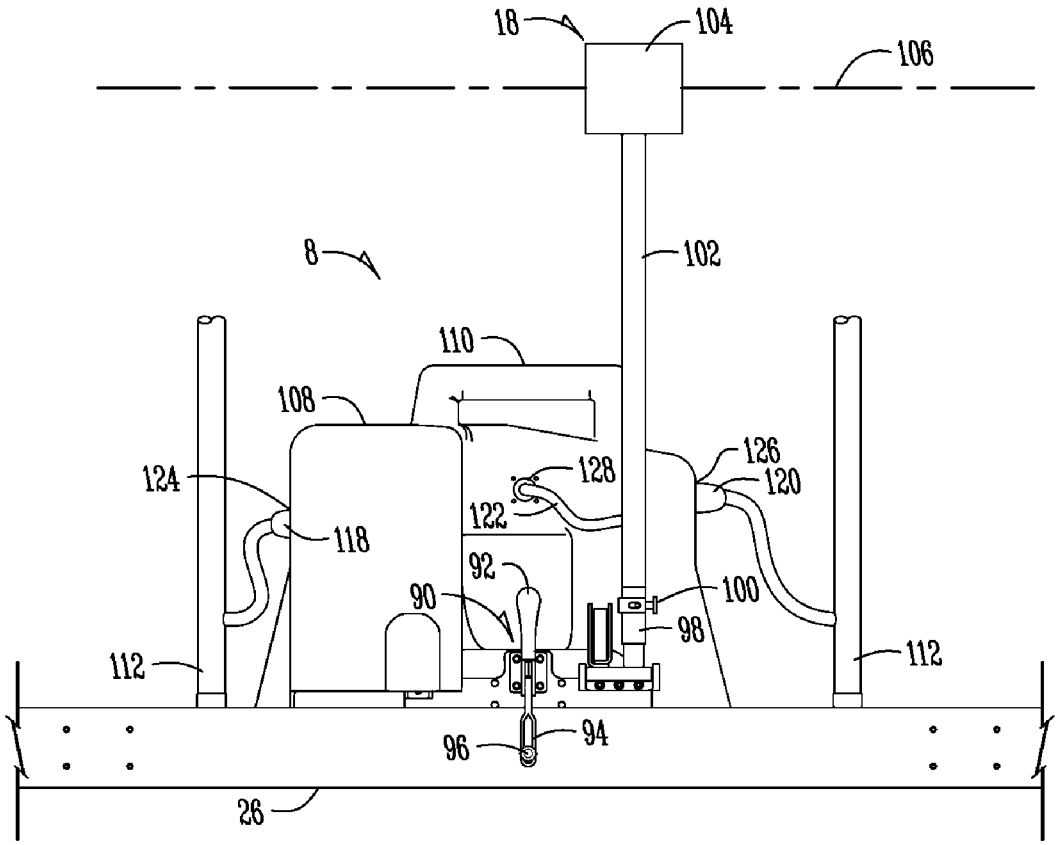
FIG. 6 is an elevational view taken along line 6-6 of FIG. 1.

Referring to FIGS. 3 and 6, a front clamp 90 includes a front clamp handle 92, a front clamp bolt holder 94, and a front clamp bolt 96. The front clamp operates in a toggle fashion from a release position wherein the bolt is out of contact with the vertical plate 22, to a locked position wherein the front bolt 94 engages the front surface 30 of the vertical plate 22. As can be seen from FIG. 3, when the rear clamps 46, 48 are in their locked position and engage the console plate 68 so as to press the console plate 68 against the vertical plate 22 of the screed 10, and when the front clamp 90 is in its closed position (FIG. 3), the console assembly 12 is locked to the screed plate 10 so that they are fixed with respect to one another. This locking action can be shown best in FIG. 3 wherein the rear clamps 48 cause the bolts 56 to engage the console plate 58, the reduced cross section upper edge 60 fits within slot 44, and the front clamp 90 is in its closed position against the front surface 30 of vertical plate 22. In order to remove the console assembly 12 from the screed plate 10, all that is necessary is to move the rear clamps 48 to their rear positions as shown in FIG. 5 and to move the front clamp 90 to its open position as well. Then it is merely a matter of tilting the console assembly 10 so as to remove the reduced cross section upper edge 60 from the slot 44 and separate the console assembly as shown in FIG. 2.

Console assembly 12 also includes a leveling socket 98 (FIG. 6) which is adapted to receive a leveling shaft 102 from leveling mechanism 18. A spring loaded button 100 is adapted to secure the two together, but the button 100 can be quickly and easily pulled outwardly to release the leveling shaft 102 during disassembly. The leveling shaft 102 includes a leveling receiver 104 at its upper end which is adapted to receive a horizontal beam of light 106. The use of the horizontal beam of light 106 permits the determination of the upper surface of the concrete relative to a fixed horizontal point. If the concrete surface is higher as shown in FIG. 3, then tilting mechanism 74 is activated to tilt screed plate 10 and cause the cutting edge 32 cuts into the uncured concrete as shown in FIG. 3. If the distance between horizontal beam of light 106 and the upper surface of the concrete increases, then the leveling mechanism 18 causes the tilt actuator 74 to tilt the screed plate 10 so that the trailing edge 38 is depressed relative to the concrete surface and therefore causes the movement of concrete to fill the space. If the distance of the horizontal beam of light 106 from the surface of the concrete is too little, then the tilt mechanism 74 causes the downward tilting action of the pointed edge 32 to penetrate into the surface of the concrete as shown in FIG. 3.

A console cover 108 is adapted to cover the console assembly 12. The console cover includes a console cover handle 110.

The handles 14, 16 each include lower ends 112 which have a socket 114 (FIG. 3) therein. The socket 114 fits over the stub shafts 88 in a telescoping fashion, and a spring loaded button 116 attaches the two together. The spring loaded button 116 is a quick connect mechanism that can be pulled outwardly to release the handles 14 for disassembly. Each handle 14 is provided with a handle plug 118, 120. The leveling mechanism 18 is provided with a leveling contact plug 122. These plugs 118, 120 and 122 are adapted to plug into plug receptacles 124, 126, 128 on the console cover 108. In turn, the console cover 108 includes internal wiring that connects the handles 14 and the leveling mechanism 118 to the various components of the console assembly. One of the handles 14, 16 has a holding stand 148 pivotally mounted thereto.

Figure 7:
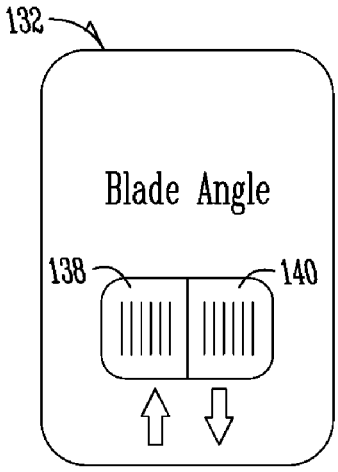
FIG. 7 is a sectional view taken along line 7-7 of FIG. 1.
Figure 8:
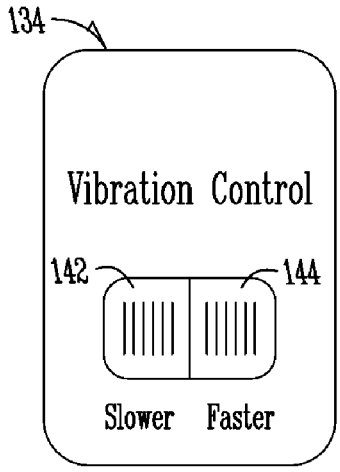
FIG. 8 is a sectional view taken along line 8-8 of FIG. 1.

The upper ends of the handles 14, 16 are each provided with an arm support 130. One of the handles 14, 16 includes a blade angle control handle 132, and the other of the handles 16 includes a vibration control handle 134. Each of the control handles 132, 134 includes an actuation trigger 136 which causes the control handle to be actuated. Referring to FIGS. 7 and 8, the buttons on the control handles 132, 134 are shown in more detail. In FIG. 7, the handle 132 includes a blade angle up button 138 and a blade angle down button 140. Thus the tilt of the blade angle can be adjusted manually if desired. However, the tilt mechanism 18 is automatic and after the tilt of the blade angle is manually determined by buttons 138, 140 corresponding to the height of the individual operating the screed device, then the tilt mechanism 18 automatically controls the tilting of the blade relative to the height of the beam of light 106 above the concrete surface.

The other vibration control handle 134 includes a vibration slower button 142 and a vibration faster button 144. These can be utilized to control the vibrating motor 84 for increasing or decreasing the frequency of vibration.

The screed device 8 of the present invention makes leveling and consolidation of concrete easier and more precise. The screed assembly 8 is DC powered, which means that no more gas, oil or electric wires are needed on the job site, and this makes the environment safer and cleaner for the operator. A laser or a beam of light is used to send signals to the control box 104 that will automatically keep the blade 10 at the finished floor elevation and will control its tilting in accordance with the level of the concrete. The screed assembly 8 can be run manually or can be run in automatic modes. The handles rotate, pivot and adjust for operator comfort, and they are pivotal about a vertical axis relative to the screed plate 10. However, if the height of the individual operator varies, then the tilt mechanism can be manually actuated to adjust the level of the handles and the tilting of the screed plate 10 to the height of the individual.

The screed assembly consists of five main components, the two handles 14, 16, the console unit 12, the tilt control 18, and the screed plate 10. The unit can be assembled and disassembled in minutes for easy clean-up and transportation.

The leading edge 32 of the blade is designed to cut into concrete and not override the high spots whereas other screeds tend to override.

Various screed blades 10 can be interchanged with the console 12 in seconds, and this is desirable in order to accommodate various lengths of screed plates 10 as well as other shapes and designs. The screed assembly 8 is designed to cut labor costs and increase efficiency on the jobsite.

Other screeds depend on wet slabs or grade pins to determine the finished floor elevation. The screed of the present invention is ergonomically designed for operator comfort and adjustment.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A screed device for permitting an operator to finish a quantity of uncured cement comprising:

a screed plate comprising a substantially horizontal surface adapted to engage the quantity of uncured cement and having a leading edge, a trailing edge, a first end, a second end, an upper surface and a lower surface;

a console assembly containing at least a vibrator capable of actuation to vibrate, the console assembly being either directly or indirectly in contact with the upper surface of the screed plate so that the vibrator when activated imparts vibrations to the screed plate;

a pair of spaced apart mounting plates on the console assembly;

an elongated pivot bar pivotally mounted between the mounting plates for pivotal movement along a longitudinal axis of the pivot bar;

one or more first quick connecting mechanisms connecting the console assembly to the screed plate;

a first handle and a second handle each having a lower end adjacent the console assembly and an upper end for grasping by the operator; and first and second handle quick connect mechanisms detachably connecting the lower ends of the first and second handles, respectively to the console assembly for quick removal of the first and second handles from the console assembly.

2. The screed device according to claim 1 wherein a horizontal beam of light is above the uncured concrete, a leveling apparatus includes a receiver for detecting the level of the horizontal beam of light, the leveling apparatus being connected between the console and the pivot bar for causing tilting of the pivot bar about the longitudinal axis thereof in response the receiver detecting of the level of the horizontal beam of light.

3. The screed device according to claim 1 and further comprising the first quick connect mechanism comprising at least one toggle pivotally mounted to one of the console assembly or the screed plate, the at least one toggle being moveable from a locked position attaching the console assembly to the screed plate to a release position disconnecting the console assembly from the screed plate.

4. The screed device according to claim 1 and wherein first and second handle quick connect mechanisms each comprise a socket and a stub shaft, telescopically inserted into the socket.

5. The screed device according to claim 4 wherein each of the stub shafts have a button extending through the socket and engaging the stub shaft.

6. The screed device of claim 1 wherein the first and second handle quick mechanisms are each detachably secured to the pivot bar.

7. A screed device for permitting an operator to finish a quantity of uncured cement comprising:

a screed plate comprising a substantially horizontal surface adapted to engage the quantity of uncured cement and having a leading edge presented toward the operator, a trailing edge presented away from the operator, a first end, and a second end;

a console assembly containing at least a vibrator capable of actuation to vibrate, the console assembly being either directly or indirectly in contact with the screed plate so that the vibrator when activated imparts vibrations to the screed plate;

a console quick connect mechanism detachably connecting the console assembly to the screed plate for quick removal of the console assembly from the screed plate, the console quick connect mechanism comprising at least one toggle pivotally mounted to one of the console assembly or the screed plate, the at least one toggle being movable from a locked position attaching the console assembly and the screed plate to a release position disconnecting the console assembly from the screed plate;

a first handle and a second handle each having a lower end adjacent the console assembly and an upper end for grasping by the operator; and first and second handle quick connect mechanisms detachably connecting the lower end of the first and second handles, respectively to the console assembly for quick removal of the first and second handles from the console assembly;

leveling apparatus movingly connected to the screed plate for tilting of the screed plate in a first direction wherein the leading edge of the screed plate is raised and the trailing edge is lowered, and for tilting of the screed plate in an opposite second direction wherein the leading edge of the screed plate is lowered and the trailing edge is raised.

8. The screed device of claim 7 wherein the at least one toggle is pivotally mounted to the screed plate for pivotal movement from a locked position engaging the console assembly to a release position free from engagement with the console assembly.

* * * * *